US005092970A

United States Patent [19]

Kaczur et al.

[11] Patent Number: 5,092,970

[45] Date of Patent: Mar. 3, 1992

[54] ELECTROCHEMICAL PROCESS FOR PRODUCING CHLORINE DIOXIDE SOLUTIONS FROM CHLORITES

[75] Inventors: Jerry J. Kaczur; David W. Cawlfield, both of Cleveland, Tenn.

[73] Assignee: Olin Corporation, Cheshire, Conn.

[21] Appl. No.: 453,552

[22] Filed: Dec. 20, 1989

[51] Int. Cl.[5] ..... C25B 1/26

[52] U.S. Cl. ..... 204/98; 204/101; 204/95; 204/129; 204/182.3; 204/182.4; 210/638; 423/477

[58] Field of Search ..... 204/95, 98, 101, 103, 204/129, 182.3, 182.4; 210/638; 423/477

[56] References Cited

U.S. PATENT DOCUMENTS

| | | | |
|---|---|---|---|
| 2,163,793 | 6/1939 | Logan | 204/101 |
| 2,717,237 | 10/1955 | Rempel | 204/101 |
| 2,815,320 | 12/1957 | Kollsman | 204/182.4 |
| 3,684,437 | 8/1972 | Callerame | 423/477 |
| 3,763,006 | 10/1973 | Callerame | 204/101 |
| 3,869,376 | 3/1975 | Tejeda | 204/182.4 |
| 3,904,496 | 9/1975 | Harke et al. | 204/101 |
| 4,432,856 | 2/1984 | Murakami et al. | 204/237 |
| 4,454,012 | 6/1984 | Bachot et al. | 204/182.4 |
| 4,542,008 | 9/1985 | Capuano et al. | 204/101 |
| 4,683,039 | 7/1987 | Twardowski et al. | 210/638 |
| 4,806,215 | 2/1989 | Twardowski | 204/101 |
| 4,915,927 | 4/1990 | Lipsztajn et al. | 204/103 |

FOREIGN PATENT DOCUMENTS

| | | |
|---|---|---|
| 1866 | 3/1956 | Japan . |
| 4569 | 6/1958 | Japan . |
| 714828 | 9/1954 | United Kingdom . |

*Primary Examiner*—John F. Niebling
*Assistant Examiner*—David G. Ryser
*Attorney, Agent, or Firm*—James B. Haglind; Paul Weinstein

[57] ABSTRACT

A process for electrolytically producing an aqueous solution of chlorine dioxide in an electrolytic cell having an anode compartment, a cathode compartment, and at least one ion exchange compartment between the anode compartment and the cathode compartment, the process comprising feeding an aqueous solution of an alkali metal chlorite to the ion exchange compartment, electrolyzing an anolyte in the anode compartment to generate hydrogen ions, passing the hydrogen ions from the anode compartment through a cation exchange membrane into the ion exchange compartment to displace alkali metal ions and produce an aqueous solution of chlorine dioxide, and passing alkali metal ions from the ion exchange compartment into the cathode compartment.

19 Claims, 1 Drawing Sheet

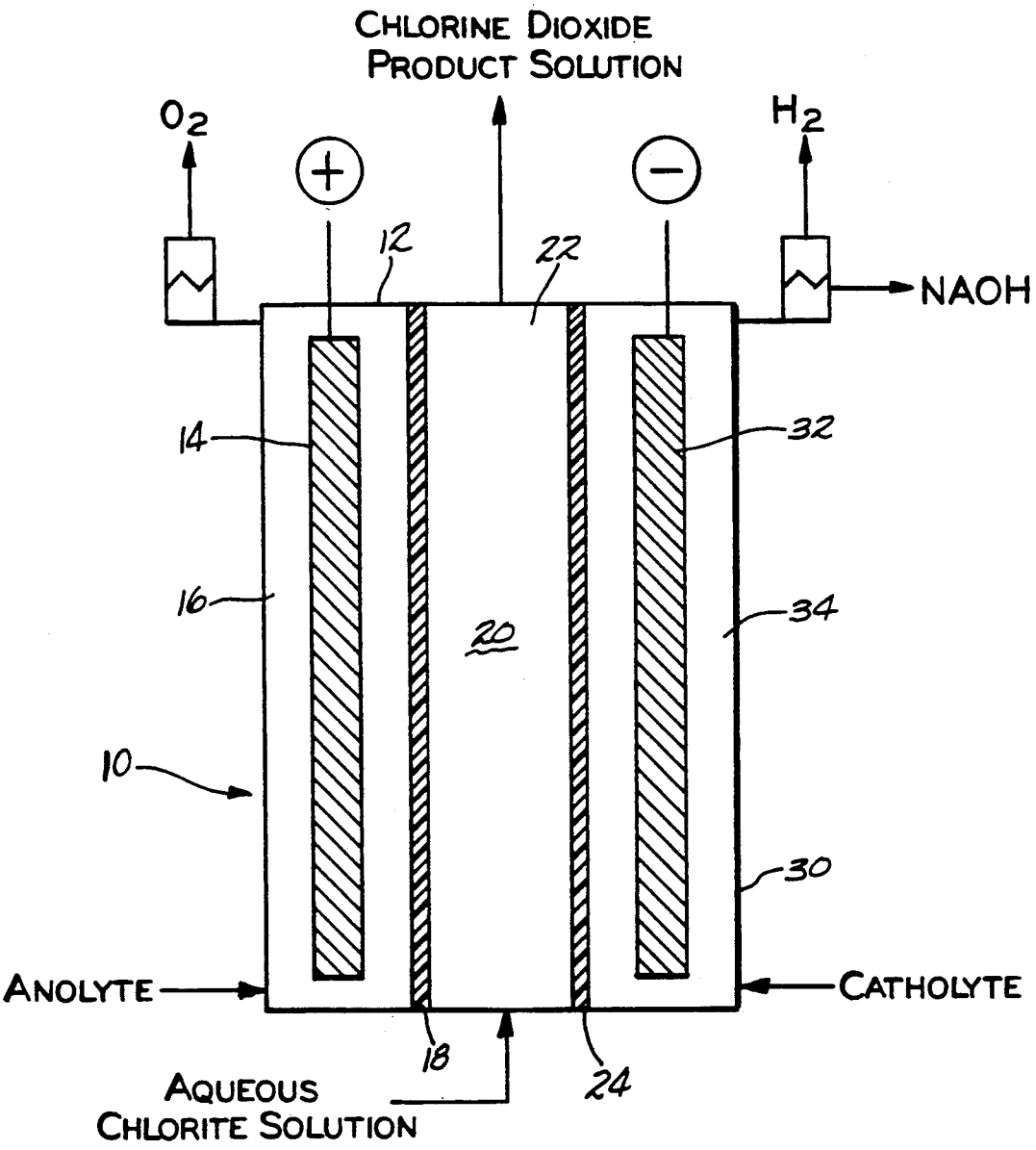
CHLORINE DIOXIDE
PRODUCT SOLUTION
$O_2$
$H_2$
NAOH
12
22
14
32
16
20
34
10
30
ANOLYTE
CATHOLYTE
18
24
AQUEOUS
CHLORITE SOLUTION

ELECTROCHEMICAL PROCESS FOR PRODUCING CHLORINE DIOXIDE SOLUTIONS FROM CHLORITES

BACKGROUND OF THE INVENTION

This invention relates to a process for electrochemically producing chlorine dioxide solutions. More particularly, this invention relates to the electrochemical production of chlorine dioxide solutions from alkali metal chlorite compounds.

Chlorine dioxide has found wide use as a disinfectant in water treatment/purification, as a bleaching agent in pulp and paper production, and a number of other uses due to its high oxidizing power. There are a number of chlorine dioxide generator systems and processes available in the marketplace. Most of the very large scale generators utilize a chlorate salt, a reducing agent, and an acid in the chemical reaction for producing chlorine dioxide. Small scale capacity chlorine dioxide generator systems generally employ a chemical reaction between a chlorite salt and an acid and/or oxidizing agent, preferably in combination. Typical acids used are, for example, sulfuric or hydrochloric acid. Other systems have also used sodium hypochlorite or chlorine as the oxidizing agent in converting chlorite to chlorine dioxide. The disadvantage of the chlorine based generating systems is the handling of hazardous liquid chlorine tanks and cylinders and the excess production of chlorine or hypochlorite depending on the system operation.

The electrochemical production of chlorine dioxide has been described previously, for example, by J. O. Logan in U.S. Pat. No. 2,163,793, issued June 27, 1939. The process electrolyzes solutions of an alkali metal chlorite such as sodium chlorite containing an alkali metal chloride or alkaline earth metal chloride as an additional electrolyte for improving the conductivity of the solution. The process preferably electrolyzes concentrated chlorite solutions to produce chlorine dioxide in the anode compartment of an electrolytic cell having a porous diaphragm between the anode and cathode compartments.

British Patent Number 714,828, published Sept. 1, 1954, by Farbenfabriken Bayer, teaches a process for electrolyzing an aqueous solution containing a chlorite and a water soluble salt of an inorganic oxy-acid other than sulfuric acid. Suitable salts include sodium nitrate, sodium nitrite, sodium phosphate, sodium chlorate, sodium perchlorate, sodium carbonate, and sodium acetate.

A process for producing chlorine dioxide by the electrolysis of a chlorite in the presence of a water soluble metal sulfate is taught by M. Rempel in U.S. Pat. No. 2,717,237, issued Sept. 6, 1955.

Japanese Patent Number 1866, published Mar. 16, 1956, by S. Saito et al (C.A. 51,6404, 1957) teaches the use of a cylindrical electrolytic cell for chlorite solutions having a porcelain separator between the anode and the cathode. Air is used to strip the $ClO_2$ from the anolyte solution.

Japanese Patent Number 4569, published June 11, 1958, by S. Kiyohara et al (C.A. 53, 14789d, 1959) teaches the use of a pair of membrane cells, in the first of which a concentrated $NaClO_2$ solution is electrolyzed in the anode compartment. Air is used to strip the $ClO_2$ from the anolyt which is then fed to the cathode compartment by the second cell. NaOH, produced in the cathode compartment of the first cell, is employed as the anolyte in the second cell.

A process for producing chlorine dioxide by the electrolysis of an aqueous solution of lithium chlorite is taught in U.S. Pat. No. 3,763,006, issued Oct. 2, 1973, to M. L. Callerame. The chlorite solution is produced by the reaction of sodium chlorate and perchloric acid and a source of lithium ion such as lithium chloride. The electrolytic cell employed a semi-permeable membrane between the anode compartment and the cathode compartment.

Japanese Disclosure Number 81-158883, disclosed Dec. 7, 1981, by M. Murakami et al describes an electrolytic process for producing chlorine dioxide by admixing a chlorite solution with the catholyte solution of a diaphragm or membrane cell to maintain the pH within the range of from 4 to 7 and electrolyzing the mixture in the anode compartment. The electrolyzed solution, at a pH of 2 or less, is then fed to a stripping tank where air is introduced to recover the chlorine dioxide.

More recently, an electrolytic process for producing chlorine dioxide from sodium chlorite has been described in which the chlorite ion concentration in the electrolyte is measured in a photometric cell to provide accurately controlled chlorite ion concentrations (U.S. Pat. No. 4,542,008, issued Aug. 17, 1985, to I. A. Capuano et al).

The electrolysis of an aqueous solution of alkali metal chlorate and alkali metal chloride in a three compartment electrolyic cell is taught in U.S. Pat. No. 3,904,496, issued Sept. 9, 1975, to C. J. Harke et al. The aqueous chlorate containing solution is fed to the middle compartment which is separated from the anode compartment by an anion exchange membrane and the cathode compartment by a cation exchange membrane. Chlorate ions and chloride ions pass into the anode compartment containing hypochloric acid as the anolyte. Chlorine dioxide and chlorine are produced in the anode compartment and chloride-free alkali metal hydroxide is formed in the cathode compartment.

An additional process for generating a chlorine dioxide solution from sodium chlorite passes a near neutral chlorite solution through an ion exchange column containing a mixture of both cation and anion ion exchange resins is described in U.S. Pat. No. 3,684,437, issued Aug. 15, 1972, to J. Callerame. The patent teaches that a very low conversion to chlorine dioxide is achieved by passing a chlorite solution through a column of cation ion exchange resin in only the hydrogen form.

There is therefore a need for a process which produces chlorine-free chorine dioxide solutions in a wide range of $ClO_2$ concentrations continuously or on demand.

SUMMARY OF THE INVENTION

It is an object of the present invention to provide an improved electrolytic process for producing a chlorine dioxide solution from aqueous chlorite directly without the need for further recovery steps of the chlorine dioxide.

It is another object of the present invention to provide a process that can produce aqueous solutions of chlorine dioxide having a wide range of $ClO_2$ concentrations which are chlorine-free.

It is a further object of the present invention to provide a process for producing chlorine dioxide solutions having high conversion rates and efficiencies.

It is an additional object of the present invention to provide a process for producing chlorine dioxide solutions which does not require the storage and handling of strong acid chemicals by electrochemically generating in-situ the required acid chemicals for efficient chlorine dioxide generation.

These and other advantages are accomplished in a process for electrolytically producing an aqueous solution of chlorine dioxide in an electrolytic cell having an anode compartment, a cathode compartment, and at least one ion exchange compartment between the anode compartment and the cathode compartment, the process which comprises feeding an aqueous solution of an alkali metal chlorite to the ion exchange compartment, electrolyzing an anolyte in the anode compartment to generate hydrogen ions, passing the hydrogen ions from the anode compartment through a cation exchange membrane into the ion exchange compartment to displace alkali metal ions and produce an aqueous solution of chlorine dioxide, and passing alkali metal ions from the ion exchange compartment into the cathode compartment.

More in detail, the novel process of the present invention is carried out in a reactor such as that illustrated by the FIGURE.

BRIEF DESCRIPTION OF THE DRAWING

The FIGURE shows an electrolytic cell 10 having anode compartment 12, ion exchange compartment 20, and a cathode compartment 30. Anode compartment 12 includes anode 14, and anolyte medium 16. Anode compartment 12 is separated from ion exchange compartment 20 by cation exchange membrane 18. Ion exchange compartment 20 includes cation exchange medium 22 and is separated from cathode compartment 30 by cation exchange membrane 24. Cathode compartment 30 includes cathode 32, and catholyte medium 34.

DESCRIPTION OF THE PREFERRED EMBODIMENTS

An aqueous solution of an alkali metal chlorite is fed to the ion exchange compartment of the electrolytic cell. Suitable alkali metal chlorites include sodium chlorite, potassium chlorite and lithium chlorite. The aqueous alkali metal chlorite solutions may contain any concentration of the alkali metal chlorite and these solutions initially have a pH in the range of from about 7 to about 13. In order to simplify the disclosure, the process of the invention will be described, using sodium chlorite which is a preferred embodiment of the alkali metal chlorites.

The novel process of the invention utilizes an electrochemical cell to generate hydrogen ions that displace or replace alkali metal cations, such as sodium, present in the chlorite solution feed stream.

The generation of hydrogen ions in the process of the present invention in the anolyte compartment is accompanied, for example, by the oxidation of water on the anode into oxygen gas and H+ ions by the electrode reaction as follows:

$$2H_2O \rightarrow O_2 + 4H^+ + 4e^- \quad (4)$$

The anode compartment contains an anolyte, which can be any non-oxidizable acid electrolyte which is suitable for conducting hydrogen ions into the ion exchange compartment. Non-oxidizable acids which may be used include sulfuric acid, phosphoric acid and the like. Where a non-oxidizable acid solution is used as the anolyte, the concentration of the anolyte is selected to match the osmotic concentration characteristics of the chlorite solution fed to the ion exchange compartment to minimize water exchange between the anode compartment and the ion exchange compartment. This also minimizes the potentiality of chlorine dioxide entering the anode compartment. Additionally, an alkali metal choride solution can be used as the anolyte, which results in a generation of chlorine gas at the anode. Where a chlorine generating anolyte is employed, it is necessary to select the cation exchange membrane separating the anode compartment from the ion exchange compartment, which is stable to chlorine gas. The anode compartment is preferably filled with a strong acid cation exchange resin in the hydrogen form and an aqueous solution such as de-ionized water as the anolyte electrolyte.

Any suitable anode may be employed in the anode compartment, including those which are available commercially as dimensionally stable anodes. Preferably, an anode is selected which will generate oxygen gas. These anodes include porous or high surface area anodes. As materials of construction metals or metal surfaces consisting of platinum, gold, palladium, or mixtures or alloys thereof, or thin coatings of such materials on various substrates such as valve metals, i.e. titanium, can be used. Additionally precious metals and oxides of iridium, rhodium or ruthenium, and alloys with other platinum group metals could also be employed. Commercially available anodes of this type include those manufactured by Englehard (PMCA 1500) or Eltech (TIR-2000). Other suitable anode materials include graphite, graphite felt, a multiple layered graphite cloth, a graphite cloth weave, carbon, etc.

The hydrogen ions generated pass from the anode compartment through the cation membrane into the sodium chlorite solution in the ion exchange compartment. As a hydrogen ion enters the stream, a sodium ion by electrical ion mass action passes through the cation membrane adjacent to the cathode compartment to maintain electrical neutrality.

The exchange of hydrogen ions for sodium ions is expressed in the following equations:

$$4H^+ + 4NaClO_2 \rightarrow 4HClO_2 + 4Na+ \quad (5)$$

$$4HClO_2 \rightarrow 2ClO_2 + HClO_3 + HCl + H_2O \quad (6)$$

The novel process of the invention is operated to maintain the pH of the sodium chlorite solution in the ion exchange compartment in the range of from about 0.1 to about 4, preferably from about 0.5 to about 3, and more preferably, from about 1 to about 2.

Thus the concentration of sodium chlorite in the solution and the flow rate of the solution through the ion exchange compartment are not critical and broad ranges can be selected for each of these parameters.

The ion exchange compartment should be maintained at temperatures below which, for safety reasons, concentrations of chlorine dioxide vapor are present which can thermally decompose. Suitable temperatures are those in the range of from about 5 to about 100, preferably at from about 10 to about 80, and more preferably at from about 20° to about 60° C.

The novel process of the present invention is operated at a current density of from about 0.01 KA/m2 to about 10 KA/m2, with a more preferred range of about 0.05 KA/m2 to about 3 KA/m2. The constant operating cell voltage and electrical resistance of the anolyte and catholyte solutions are limitations of the operating cell current density that must be traded off or balanced with current efficiency and the conversion yield of chlorite to chlorine dioxide.

To promote more efficient conversion of chlorite to chlorine dioxide, the chlorite feed solution may contain additives in the form of salts such as alkali metal chlorides, phosphates, sulfates etc. In this embodiment, where an alkali metal chloride is used as the additive, the reaction is illustrated by the following equation:

$$5HClO_2 \rightarrow 4ClO_2 + H^+ + Cl^- + 2H_2O \quad (7)$$

Any suitable amounts of salts as additives may be added to the alkali metal chlorite solution feed to the ion exchange compartment to increase the efficiency of the process. Maximum conversions of $NaClO_2$ to $ClO_2$ have been found, for example, where the additive is an alkali metal chloride, when the molar ratio of alkali metal chloride ion to chlorite, is at least about 0.5 being preferably greater than about 0.8, i.e. from about 1 to about 5.

Current efficiencies during operation of the process of the invention can also be increased by employing additional ion exchange compartments which are adjacent and operated in series.

In an alternate embodiment the ion exchange compartment contains a cation exchange medium. Cation exchange mediums which can be used in the ion exchange compartment include cation exchange resins. Suitable cation exchange resins include those having substrates and backbones of polystyrene based with divinyl benzene, cellulose based, fluorocarbon based, synthetic polymeric types and the like.

Functional cationic groups which may be employed include carboxylic acid, sulfonic or sulfuric acids, acids of phosphorus such as phosphonous, phosphonic or phosphoric. The cation exchange resins are suitably conductive so that a practical amount of current can be passed through the cation exchange membranes used as separators. A mixture of resins in the hydrogen form and the sodium form may be used in the ion exchange compartment to compensate for the swelling and contraction of resins during cell operation. For example, percentage ratios of hydrogen form to sodium form may include those from 50 to 100%. The use of cation exchange resins in the ion exchange compartment can act as a mediator which can exchange or absorb sodium ions and release hydrogen ions. The hydrogen ions generated at the anode thus regenerate the resin to the hydrogen form, releasing sodium ions to pass into the cathode compartment. Their employment is particularly beneficial when feeding dilute sodium chlorite solutions as they help reduce the cell voltage.

Preferred as cation exchange mediums are strong acid cation exchange resins in the hydrogen form and are exemplified by low cross-linked resins such as AMBERLITE® IRC-118 (Rohm and Haas Co.) as well as higher crosslinked resins i.e. AMBERLITE® IRC-120. High surface area macroreticular or microporous type ion exchange resins having sufficient electrical conductivity, such as AMBERLYST®-19 and AMBERLYST®-31 (Rohm and Haas Co.), are also suitable as long as the cross-linking is low (for example, from about 5 to about 10%)

Physical forms of the cation exchange resin which can be used are those which can be packed into compartments and include beads, rods, fibers or a cast form with internal flow channels. Bead forms of the resin are preferred.

Cation exchange membranes selected as separators between compartments are those which are inert, flexible membranes, and are substantially impervious to the hydrodynamic flow of chlorite solution or the electrolytes and the passage of any gas products produced in the anode or cathode compartments. Cation exchange membranes are well-known to contain fixed anionic groups that permit intrusion and exchange of cations, and exclude anions from an external source. Generally the resinous membrane or diaphragm has as a matrix, a cross-linked polymer, to which are attached charged radicals such as $-SO^-3$ and/or mixtures thereof with $-COOH^-$. The resins which can be used to produce the membranes include, for example, fluorocarbons, vinyl compounds, polyolefins, hydrocarbons, and copolymers thereof. Preferred are cation exchange membranes such as those comprised of fluorocarbon polymers having a plurality of pendant sulfonic acid groups or carboxylic acid groups or mixtures of sulfonic acid groups and carboxylic acid groups and membranes of vinyl compounds such as divinyl benzene. The terms "sulfonic acid group" and "carboxylic acid groups" are meant to include salts of sulfonic acid or salts of carboxylic acid groups by processes such as hydrolysis.

Suitable cation exchange membranes are readily available, being sold commercially, for example, by Ionics, Inc., RAI Research Corp., Sybron, by E.I. DuPont de Nemours & Co., Inc., under the trademark "NAFION®", by the Asahi Chemical Company under the trademark "ACIPLEX®", and by Tokuyama Soda Co., under the trademark "NEOSEPTA®".

The catholyte can be any suitable aqueous solution, including alkali metal chlorides, and any appropriate acids such as hydrochloric, sulfuric, phosphoric, nitric, acetic or others. In a preferred embodiment, ionized or softened water or sodium hydroxide solution is used as the catholyte in the cathode compartment to produce a chloride-free alkali metal hydroxide. The water selection is dependent on the desired purity of the alkali metal hydroxide by-product. The cathode compartment may also contain a strong acid cation exchange resin.

Any suitable cathode which generates hydrogen gas may be used, including those, for example, based on nickel or its alloys, including nickel-chrome based alloys; steel, including stainless steel; graphite, graphite felt, a multiple layered graphite cloth, a graphite cloth weave, carbon; and titanium or other valve metals. The cathode is preferably perforated to allow for suitable release of the hydrogen gas bubbles produced at the cathode particularly where the cathode is placed against the membrane.

A thin protective spacer such as a chemically resistant plastic mesh can be placed between the membrane and the anode surface to provide for use of expanded metal anodes when using a liquid anolyte in the anode compartment. A spacer can also be used between the cathode and cation exchange separating the ion exchange compartment from the cathode compartment membrane.

It will be recognized that other configurations of the electrolytic cell can be employed in the novel process of the present invention, including those having additional ion exchange compartments between the anode and cathode compartments as well as bipolar cells using a solid plate type anode/cathode. For example, a bipolar electrode could include a valve metal such as titanium or niobium sheet clad to stainless steel. The valve metal side could be coated with an oxygen evaluation catalyst and would serve as the anode. An alternative anode/-cathode combination is a platinum clad layer on stainless steel or niobium or titanium which is commercially available and is prepared by heat/pressure bonding.

In these configurations, separators or spacers may be used between the cation exchange membranes and the electrodes to provide a gas release zone.

Chlorine-free chlorine dioxide solutions produced by the process of the invention include those of a wide range of $ClO_2$ concentrations (g/l.), for example from about 0.1 to about 100 g/l., with preferred chlorine dioxide solutions containing $ClO_2$ concentrations of from about 0.5 to about 80, and more preferably from about 1 to about 50 g/l. As the concentration of $ClO_2$ increases, it is advisable to adjust process parameters such as the feed rate of the alkali metal chlorite solution and/or the current density to maintain the temperature of the ion exchange compartment within the more preferred temperature range as described above.

Where stronger chlorine dioxide product solutions are required, it is possible to obtain the desired product by using a higher concentration sodium chlorite feed solution of, for example, from about 50 to about 70 g/l in conjunction with an above atmospheric pressure in the cell 10. The higher pressure, from about 1.2 to about 5 atmospheres, is necessary to prevent the potentially explosive chlorine dioxide at concentrations of above about 50 g/l from coming out of solution into the explosive vapor phase.

To further illustrate the invention the following examples are provided without any intention of being limited thereby. All parts and percentages are by weight unless otherwise specified.

EXAMPLES 1-4

An electrochemical cell of the type shown in the Figure was employed having an anode compartment, a central ion exchange compartment, and a cathode compartment. The anode compartment contained a titanium mesh anode having an oxygen-evolving anode coating (PMCA 1500® Englehard Corporation, Edison, N.J.) The anode compartment was filled with a strong cation exchange resin (AMBERLITE®, IRC-120+, Rohm & Haas Co., Philadelphia, Pa.) in the hydrogen form. The ion exchange compartment was filled with AMBERLITE® IRC-120+, in the hydrogen form. The cathode compartment contained a stainless steel perforated plate cathode. The cathode compartment was initially filled with a sodium hydroxide solution (2% by weight) as the catholyte. Separating the anode compartment from the ion exchange compartment, and the ion exchange compartment from the cathode compartment were a pair of hydrocarbon based cation exchange membranes (NEOSEPTA® C-6610F, Tokuyama Soda Co.) having sulfonic acid ion exchange groups. In the cathode compartment a thin polyethylene separator was placed between the cation exchange membrane and the cathode. During operation of the electrolytic cell, an aqueous sodium chlorite solution containing 10.5 g/l of $NaClO_2$ was prepared from a technical solution (Olin Corp. Technical sodium chlorite solution 31.25). To this solution was added NaCl to provide a molar ratio of NaCl: $NaClO_2$ of 1.75. The chlorite solution was continuously metered into the bottom of the ion exchange compartment. As the anolyte, deionized water was fed to the anode compartment, and deionized water was fed as the catholyte to the cathode compartment. The cell was operated at varying cell currents, cell voltages, and residence times to produce aqueous chlorine dioxide solutions. Periodically a sample of the product solution was taken and analyzed for chlorine dioxide and sodium chlorite content. The collected samples of product solution were stored in a sealed container and analyzed after specified time periods. The results are given in Table I below.

EXAMPLE 5

The procedure of Examples 1-4 was followed exactly with the exception that the aqueous sodium chlorite feed solution (10.5 g/l) contained NaCl in an amount which provided a molar ratio of NaCl to $NaClO_2$ of 3.23. The results are given in Table 1 below.

EXAMPLE 6

The procedure of Examples 1-4 was followed exactly with the exception that the aqueous sodium chlorite feed solution contained 5 g/l of $NaClO_2$ and NaCl in an amount which provided a molar ratio of NaCl to $NaClO_2$ of 3.23. The results are given in Table 1 below.

EXAMPLE 7

The cathode compartment of the electrolytic cell of Examples 1-6 was filled with a strong cation exchange resin (AMBERLITE®, IRC-120+, Rohm & Haas Co., Philadelphia, Pa.) in the sodium form. Separating the anode compartment from the ion exchange compartment, and the ion exchange compartment from the cathode compartment were a pair of fluorocarbon based cation exchange membranes (NAFION® 117, DuPont Co.) having sulfonic acid ion exchange groups. The procedure of Examples 1-4 was followed exactly with the exception that the aqueous sodium chlorite feed solution contained 10.1 g/l of $NaClO_2$ and NaCl in an amount which provided a molar ratio of NaCl to $NaClO_2$ of 4.88. The results are given in Table 1 below.

EXAMPLE 8

The procedure of Example 7 was followed exactly with the exception that NaCl was not added to the aqueous sodium chlorite feed solution (10 g/l). The results are given in Table 1 below.

EXAMPLE 9

The procedure of Example 7 was followed exactly using a sodium chlorite solution containing 20 g/l of $NaClO_2$ and NaCl in an amount which provided a molar ratio of NaCl to $NaClO_2$ of 1.83. The results are given in Table 1 below.

TABLE I

| | | Electrochemical Production of Chlorine Dioxide Solution | | | | | | | | |
|---|---|---|---|---|---|---|---|---|---|---|
| | | Cell Feed | | Cell | Product Solution | | | | | |
| | Time (Min) | Cell Volts | Cell Amps | Flowrate g/min | Residence Time (min) | ClO2 gpl | NaClO2 gpl | Temp °C. | pH | Percent Conversion To Chlorine Dioxide |
| Example No. 1 | 0 | 9.2 | 8.0 | 31.0 | 3.7 | 2.52 | 4.25 | 39 | 1.50 | 32.2 |
| Stored Sample | 30 | — | — | — | | 4.37 | 0 | 25 | 1.60 | 55.8 |
| Stored Sample | 60 | — | — | — | | 4.76 | 0 | 25 | 1.62 | 60.8 |
| Example No. 2 | 0 | 12.4 | 12.0 | 31.0 | 3.7 | 3.04 | 2.47 | 50 | 1.47 | 38.7 |
| Stored Sample | 60 | — | — | — | | 4.39 | 0 | 25 | 1.55 | 55.9 |
| Example No. 3 | 0 | 5.7 | 5.0 | 46.3 | 2.5 | 1.79 | 3.83 | 31 | 1.98 | 22.9 |
| Stored Sample | 30 | — | — | — | | 3.30 | 1.89 | 25 | 2.22 | 42.1 |
| Stored Sample | 60 | — | — | — | | 4.22 | 0 | 25 | 2.38 | 53.9 |
| Example No. 4 | 0 | 7.7 | 8.0 | 16.5 | 7.0 | 3.42 | 1.65 | 43 | 1.35 | 43.7 |
| Stored Sample | 30 | — | — | — | | 4.48 | 0 | 25 | 1.40 | 57.2 |
| Example No. 5 | 0 | 9.0 | 12.0 | 31.0 | 3.7 | 4.26 | 1.25 | 50 | 1.20 | 54.4 |
| Stored Sample | 30 | — | — | — | | 5.10 | 0 | 25 | 1.51 | 65.1 |
| Example No. 6 | 0 | 9.0 | 10.0 | 19.0 | 6.1 | 2.30 | — | 51 | 2.03 | 58.7 |
| Example No. 7 | 0 | 7.3 | 10.0 | 20.0 | 5.75 | 4.30 | 1.16 | 44 | 1.17 | 58.8 |
| Stored Sample | 30 | — | — | — | | 4.90 | 0.10 | 25 | 1.30 | 65.0 |
| Example No. 8 | 0 | 8.52 | 10.0 | 20.0 | 5.75 | 2.30 | 2.93 | 49 | 1.52 | 30.8 |
| Stored Sample | 30 | — | — | — | | 2.40 | 2.45 | 25 | 1.60 | 32.2 |
| Example No. 9 | 0 | 8.1 | 14.0 | 19.8 | 5.80 | 8.69 | 1.03 | 52 | 1.20 | 58.3 |
| Stored Sample | 30 | — | — | — | | 9.17 | 0 | 25 | 1.05 | 61.5 |

What is claimed is:

1. A process for electrolytically producing an aqueous solution of chlorine dioxide in an electrolytic cell having an anode compartment, a cathode compartment, and at least one ion exchange compartment between the anode compartment and the cathode compartment, the process which comprises feeding an aqueous solution of an alkali metal chlorite to the ion exchange compartment, electrolyzing an anolyte in the anode compartment to generate hydrogen ions, passing the hydrogen ions from the anode compartment through a cation exchange membrane into the ion exchange compartment to displace alkali metal ions and produce an aqueous solution of chlorine dioxide, and passing alkali metal ions from the ion exchange compartment into the cathode compartment.

2. The process of claim 1 in which the aqueous solution of chlorine dioxide has a pH in the range of from about 0.1 to about 4.

3. The process of claim 1 in which the anolyte is a cation exchange resin in the hydrogen form and water.

4. The process of claim 1 in which the anolyte is an aqueous solution of a non-oxidizable acid.

5. The process of claim 1 in which the aqueous solution of alkali metal chlorite is selected from the group consisting of sodium chlorite, potassium chlorite, and lithium chlorite.

6. The process of claim 5 in which the aqueous solution of alkali metal chlorite is sodium chlorite.

7. The process of claim 6 in which the aqueous solution of sodium chlorite contains an alkali metal chloride.

8. The process of claim 7 in which the molar ratio of alkali metal to sodium chlorite is at least 0.5.

9. The process of claim 8 in which the aqueous solution of sodium chlorite has a pH in the range of from about 0.5 to about 3.

10. The process of claim 8 in which the cathode compartment contains a cation exchange resin in the alkali metal form.

11. The process of claim 1 in which the ion exchange compartment contains a cation exchange resin in the hydrogen form.

12. The process of claim 1 in which the cathode compartment contains water or an alkali metal hydroxide solution.

13. The process of claim 1 in which oxygen gas is produced in the anode compartment.

14. The process of claim 1 in which hydrogen gas is produced in the cathode compartment.

15. The process of claim 14 in which the alkali metal ions from the ion exchange compartment pass through a cation exchange membrane.

16. The process of claim 1 in which the aqueous solution of alkali metal chlorite contains an alkali metal salt selected from the group consisting of chlorides, phosphates, and sulfates.

17. The process of claim 1 in which the current density is from about 0.1 to about 10 $KA/m^2$.

18. The process of claim 1 in which the electrolysis is conducted at above atmospheric pressure.

19. The process of claim 7 in which the molar ratio of alkali metal chloride to sodium chlorite is from about 1 to about 5.

* * * * *